US005927047A

United States Patent [19]

Bartels

[11] Patent Number: 5,927,047

[45] Date of Patent: Jul. 27, 1999

[54] DEVICE AND METHOD IN WRAPPING MACHINE

[75] Inventor: Willy Bartels, Mönchengladbach, Germany

[73] Assignee: Fas Converting Machinery AB, Ystad, Sweden

[21] Appl. No.: 08/894,529

[22] PCT Filed: Feb. 20, 1996

[86] PCT No.: PCT/SE96/00230

§ 371 Date: Nov. 17, 1997

§ 102(e) Date: Nov. 17, 1997

[87] PCT Pub. No.: WO96/26112

PCT Pub. Date: Aug. 29, 1996

[30] Foreign Application Priority Data

Feb. 21, 1995 [SE] Sweden ..... 9500643

[51] Int. Cl.[6] ..... B65B 13/16; B65B 11/04

[52] U.S. Cl. ..... 53/399; 53/587; 53/215

[58] Field of Search ..... 53/399, 465, 587, 53/593, 211, 215, 377.4, 383.1, 389.3

[56] References Cited

U.S. PATENT DOCUMENTS

| | | | |
|---|---|---|---|
| 2,048,042 | 7/1936 | Wedge | 53/215 X |
| 3,013,367 | 12/1961 | Sarre | 53/211 X |
| 4,333,301 | 6/1982 | Koutonen et al. | 53/215 X |
| 4,553,372 | 11/1985 | Back | 53/587 X |
| 4,608,807 | 9/1986 | Skirpalle . | |
| 4,694,959 | 9/1987 | Ausnit et al. | 53/593 X |
| 4,858,844 | 8/1989 | Stenqvist . | |
| 4,950,217 | 8/1990 | Stenqvist . | |
| 5,003,751 | 4/1991 | Ishikawa | 53/215 |
| 5,046,298 | 9/1991 | Norkoski et al. | 53/587 X |
| 5,282,345 | 2/1994 | Darcy et al. | 53/593 X |
| 5,469,688 | 11/1995 | Dunbar et al. | 53/461 X |

FOREIGN PATENT DOCUMENTS

| | | | |
|---|---|---|---|
| A-0 499 954 | 8/1992 | European Pat. Off. . | |
| 2065102 | 12/1974 | Germany . | |
| 5294311 | 11/1993 | Japan | 53/587 |
| 454871 | 6/1988 | Sweden . | |
| 1137019 | 1/1985 | U.S.S.R. | 53/211 |

OTHER PUBLICATIONS

"Fas Classic" Pamphlet.

*Primary Examiner*—Linda Johnson

*Attorney, Agent, or Firm*—Smith, Gambrell & Russell; Beveridge, DeGrandi, Weilacher & Young Intellectual Property Group

[57] ABSTRACT

A device for applying a wrapping round a cylindrical roll of bags comprises a wrapping unit (4) for winding a web section (9) round a roll of bags (13) in a winding station. The wrapping unit (4) comprises a means (17) for feeding the front end portion of the web section (9), as seen in the feeding direction, to a site adjacent to the circumferential surface of the roll of bags (13). In addition, the wrapping unit (4) comprises a means (11, 14) which is adapted to grip the roll of bags (13) and the adjacent front end portion of the web section (9) as well as to rotate the roll of bags (13) about its longitudinal axis so as to wind the web section (9) round it. The wrapping unit (4) further has means for connecting the rear end portion of the web section (9) to the web section (9) wound round the roll of bags. A device of the above type is advantageously utilised in a method for applying a wrapping round a cyclindrical roll of bags.

11 Claims, 5 Drawing Sheets

DEVICE AND METHOD IN WRAPPING MACHINE

FIELD OF THE INVENTION

The present invention relatqs to a device and a method for the application of a wrapping round a cylindrical roll of bags.

DESCRIPTION OF THE PRIOR ART

In the production of rolls of bags, for instance rolled-up plastic bags, the production line is normally composed of a number of machines which are connected in series and each of which performs at least one operation. The production line may, for instance, begin with a so-called bag machine, to which is fed an elongate material web in the form of a double plastic film. The bag machine makes transverse, bag-defining perforation lines and welding lines in the plastic web.

U.S. Pat. No. 950,217 teaches such a bag machine, which has d driven roll nip by means of which the plastic web is fed into the machine. The bag machine is equipped with a rotary knife means for producing perforation lines, as well as movable welding means for producing welding lines.

After the bag machine, there is usually provided a machine for winding plastic bags into rolls, this machine being commonly referred to as a spinner. U.S. Pat. No. 858,844 discloses such a machine, in which a free end of the plastic web is fed into a special device for winding up the web into a roll of bags. When a predetermined web length, or a predetermined number of bags, has been sensed, a clamping device clamps the web in operation, and the web is immediately torn in two along a perforation line. After a delay, the new free end of the web is gripped by a gripping device prior to yet another winding operation.

If the resulting roll of bags is to be provided with a wrapping keeping it together round its circumferential surface, the production line normally ends with a wrapping machine. This machine comprises a unit for supplying a web, for instance a paper web, which is to form the wrapping, a unit for cutting the paper web into web sections of suitable length, as well as a unit for conveying the web sections to the winding machine.

When a roll of bags is to be provided with a wrapping, a paper-web section is conveyed up to the roll of bags before the latter is completely wound up in the winding machine. Before the plastic web is torn in two along a perforation line, the free end portion of the web section is inserted into and clamped in the fold between the plastic web and the partly wound-up plastic roll. When the plastic roll is further rotated, the plastic web is torn in two along a perforation line in the manner described above, the web section clamped in the roll of bags being wound round this roll. After the winding has been completed, the wrapping is fixed, for instance by means of glue dots applied beforehand.

A prior-art wrapping machine is disclosed in the applicant's brochure "FAS Classic", 1993, which also describes the bag machine and the winding machine discussed above. Together, the bag machine and the winding machine form a production line for rolls of bags, the plastic web being fed through the machines in one direction. The wrapping machine is arranged after the production line, and its paper web is fed in a direction opposite to that of the plastic web. Thus, the two webs thus meet in an interface between tile wrapping machine and the winding machine, the rolls of bags being here provided with a wrapping.

However, the prior-art machine for applying a wrapping round rolls of bags suffers from a number of drawbacks. Thus, one. serious drawback is that the machine is dependent on the other machines in the production line. The fact that the wrapping machine must, In operation, be connected to the winding machine means that no intermediate storage of rolls of bags is possible. As a result, the production becomes less flexible than would be desired.

In addition, this combination of machines makes it difficult to stretch the web section round the roll of bags. For this reason, the free end portion of the web section has to be fixedly connected to the roll of bags before the web section is wound round the roll of bags, since there would otherwise be a considerable risk of the wrapping being too loosely applied, thus possibly falling off the roll of bags, after the sealing operation.

OBJECTS OF THE INVENTION

One object of this invention is, therefore, to provide a solution to the above problems associated with the prior art, i.e. to provide a wrapping machine which is able to cooperate with the other machines of all existing production line independently of these.

Furthermore, the inventive machine should be capable of sealing and fixing the wrappings round the rolls of bags in a fully satisfactory manner.

Another object of the invention is to provide a method remedying the drawbacks described above.

SUMMARY OF THE INVENTION

These and other objects, which will appear from the description below, have now been achieved by a device as set forth in appended claim 1 and a method as set forth in appended claim 8. Preferred embodiments and variants of the invention are stated in dependent claims 2–7 and 9–11, respectively.

By using a device and a method according to the invention, the production of rolls of bags can be rendered more flexible as well as more efficient. The inventive device is capable of serving several parallel production lines simultaneously, Also, the device enables intermediate storage of the rolls of bags, which facilitates production in so far as the line capacity of producing rolls of bags can be rendered independent of the capacity of the wrapping machine.

BRIEF DESCRIPTION OF THE DRAWINGS

For exemplifying purposes, the invention will now be described in more detail with reference to the accompanying drawings. which illustrate a currently preferred embodiment of the invention and in which.

DESCRIPTION OF EMBODIMENTS OF THE INVENTION

Figure 1:
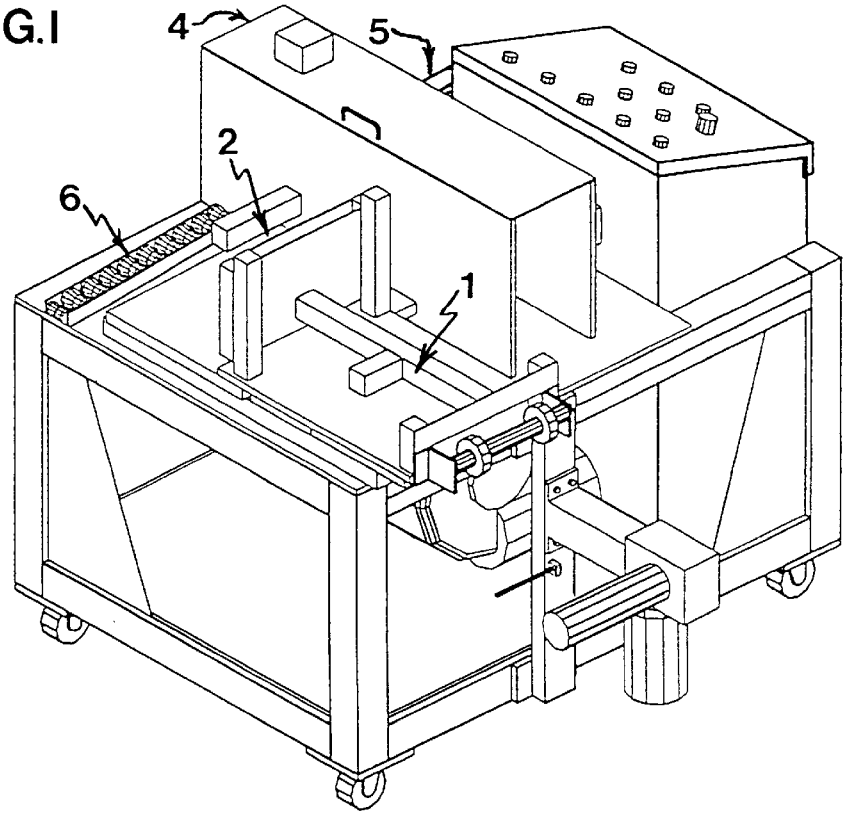
FIG. 1 is a perspective view obliquely from above, showing a device or machine according to the invention.
Figure 2:
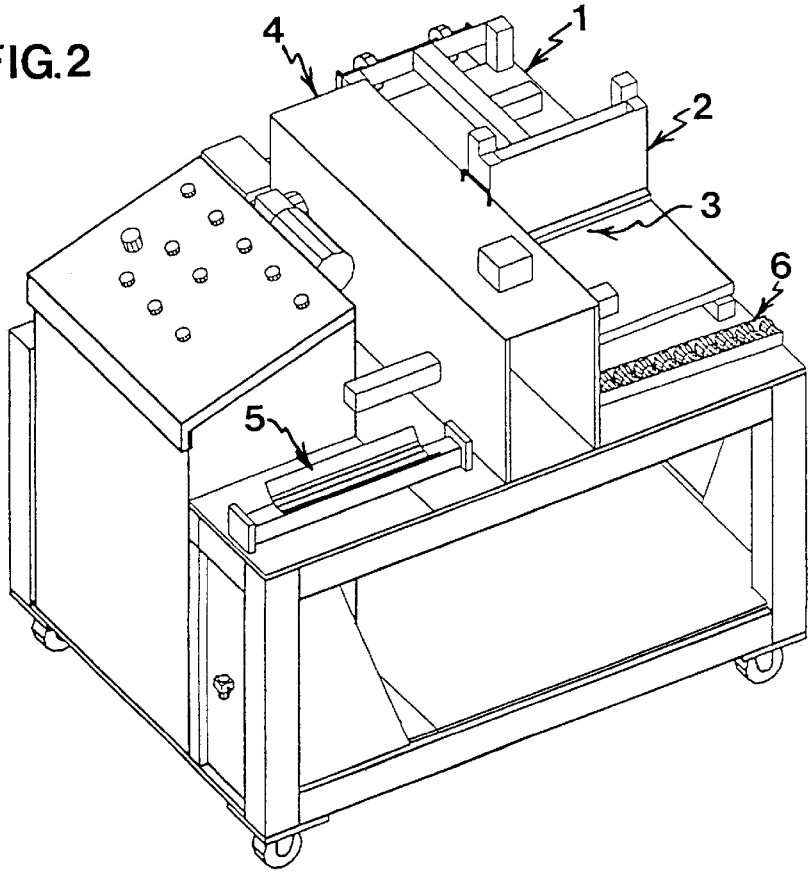
FIG. 2 is a perspective view obliquely from above, showing the machine in FIG. 1 as seen from the opposite. side.

FIGS. 1 and 2 are perspective views, illustrating an embodiment of the wrapping machine according to the invention. This machine comprises a unit 1 for feeding in a web, for instance a paper web, which is to form the wrappings, a cutting unit 2 for cutting the paper web into web sections, and a gluing unit 3 for applying a glue thread on the rear end portion of a web section. Furthermore, the machine is equipped with a wrapping unit 4 for wrapping or winding the web section round a roll of bags and applying the glue thread against the web section thus wound round the roll of bags. Accordingly, the machine provides the rolls of bags with closed wrappings, to be compared with the girdle of a cigar.

The wrapping machine further comprises a unit 5 for supplying rolls of bags to a winding station in the wrapping unit 4. The rolls of bags may, for instance, be supplied directly from a separate machine for winding the bags into rolls, such as a spinner, or from an intermediate store of rolls of bags.

Moreover, the wrapping machine is equipped with a unit 6 for discharging the finished, wrapped rolls of bags.

Figure 3:
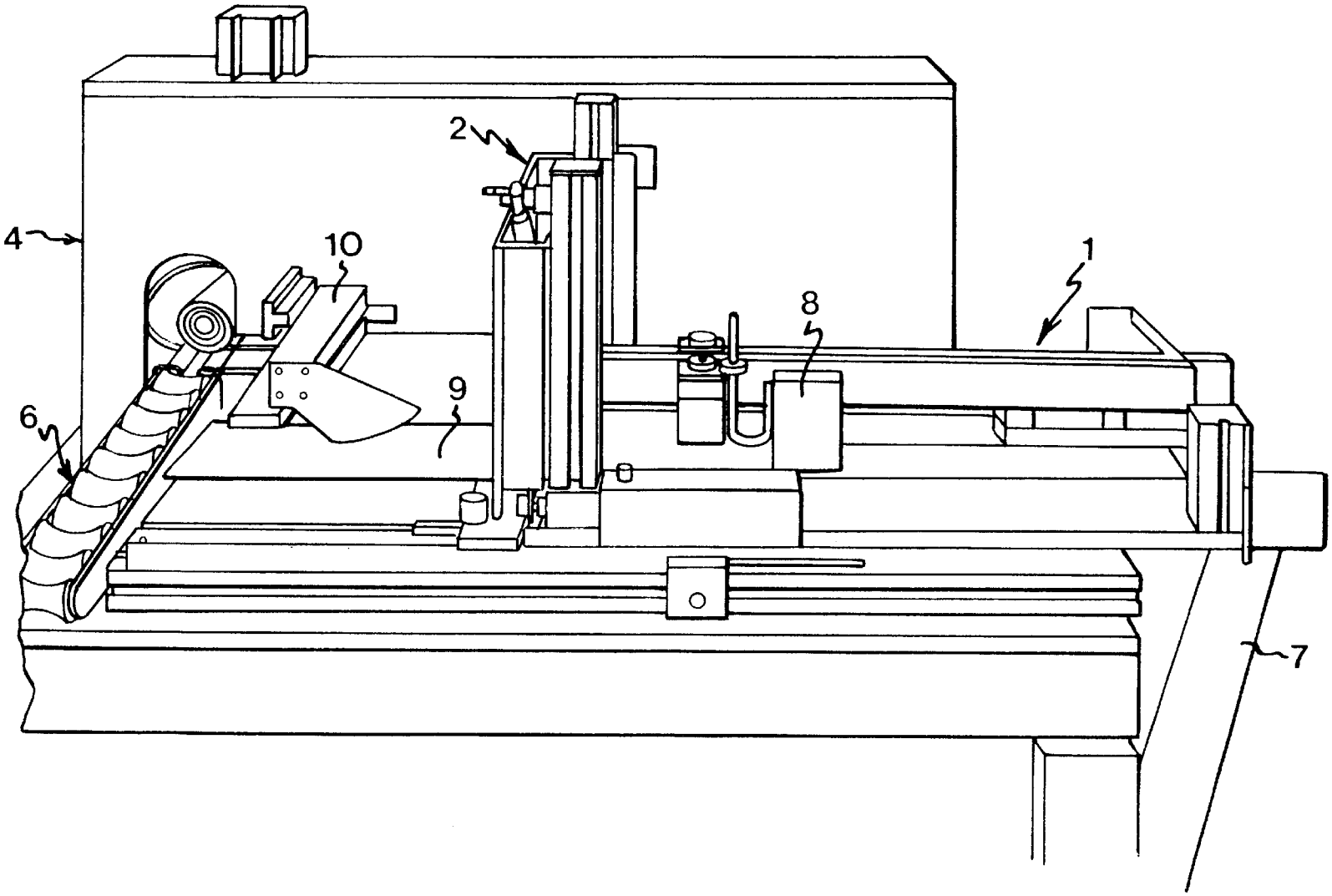
FIG. 3 is a perspective view showing part of the machine in FIGS. 1 and 2.

FIG. 3 illustrates in more detail the unit 1 for feeding in a paper web 7. The feed-in unit 1 has an optical sensor 8, which senses the position of the paper web 7 along the feed-in unit 1. The feeding is so controlled that a suitable length of the paper web 7 is propelled, whereupon it is cut into a web section 9 by means of the cutting unit 2.

An arm 10, which is movable in a direction perpendicular to the feed-in direction of the paper web, is adapted to convey the web section 9 from the feed-in unit 1 or cutting unit 2 to the wrapping unit 4. The arm 10 is provided with negative-pressure means (not shown), which by suction keep the web section 9 in place when this is being conveyed.

On its way from the cutting unit 2 to the wrapping unit 4, the web section passes a gluing unit (not shown), for instance a glue gun. The gluing unit is adapted to apply a glue thread to the rear end portion, as seen in the feed-in direction, of the passing web section 9, Consequently, this expedient conveyance of the web section 9 from the cutting unit 2 to the wrapping unit 4 permits the use of a stationary gluing unit which enables a wrapping machine of simpler design.

Figure 4:
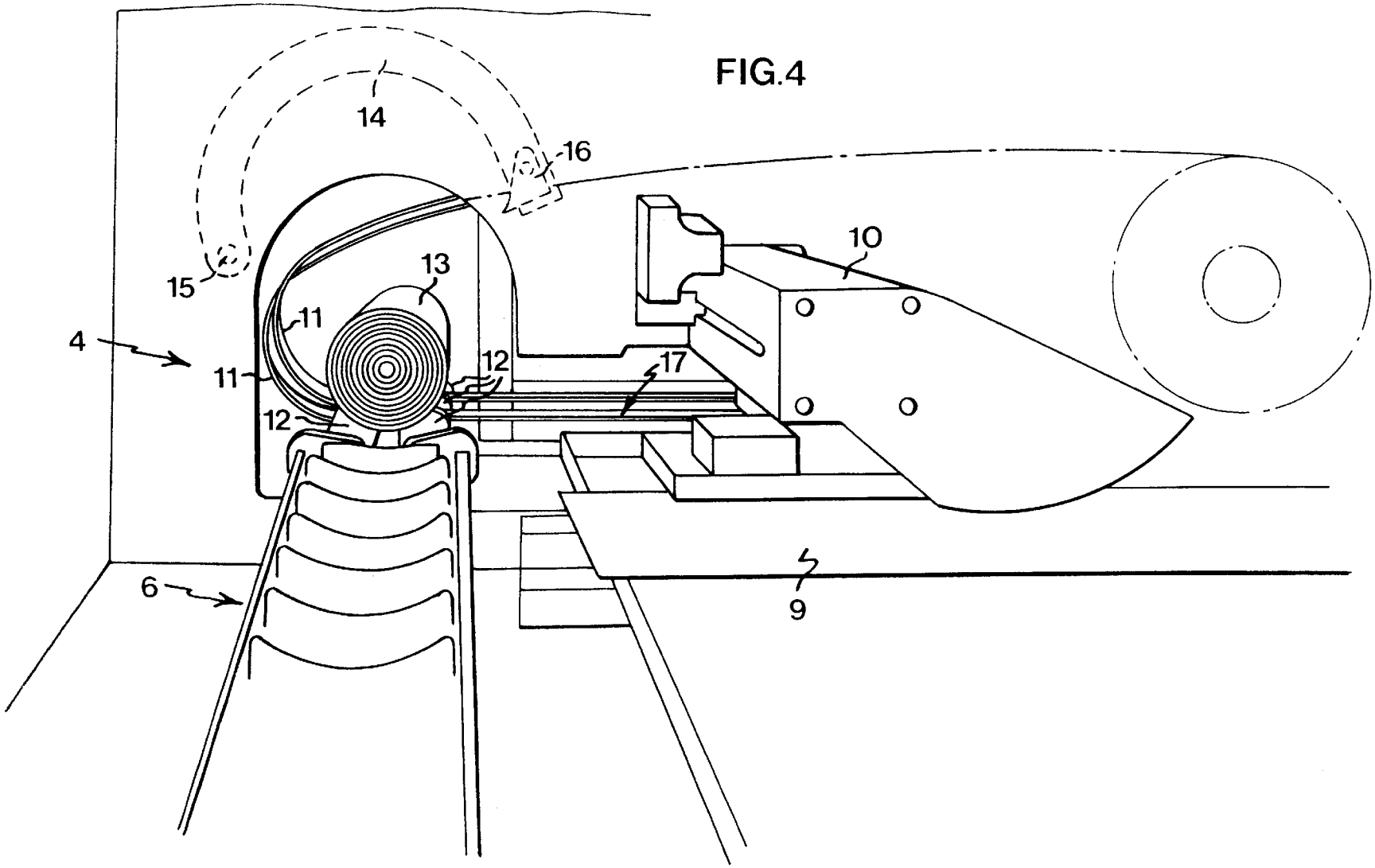
FIG. 4 is a side view of part of FIG. 3, showing the initial position of a roll of bags fed to a wrapping unit, certain hidden components of the wrapping unit being indicated by dashed lines.
Figure 6:
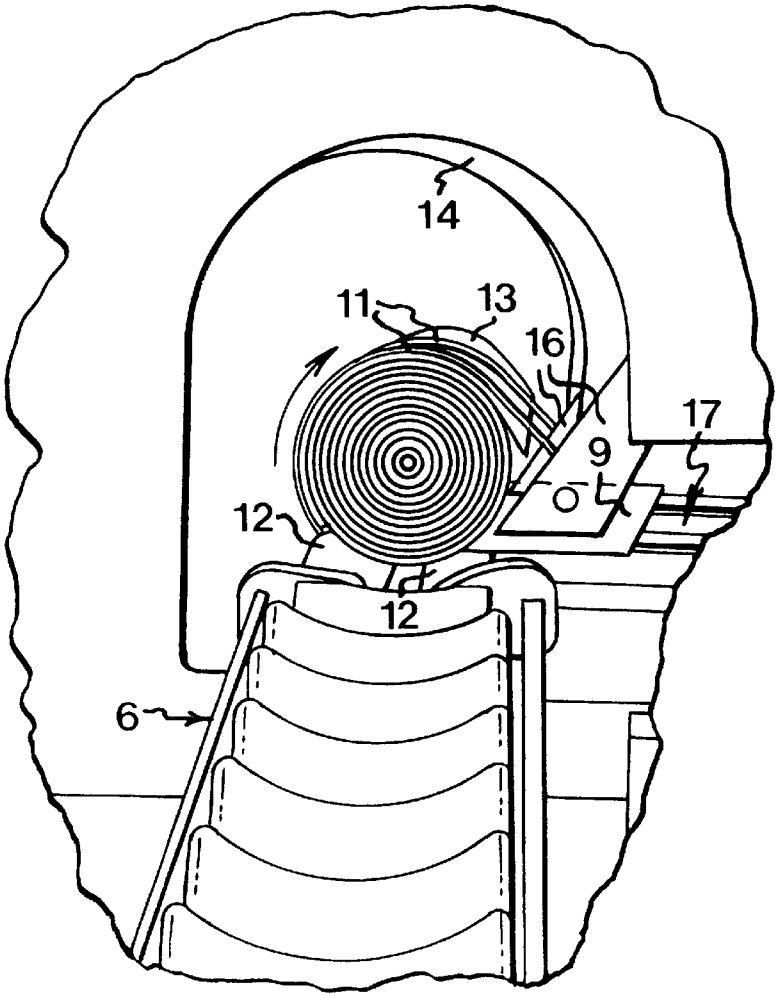
FIG. 6 is an enlarged side view showing a second intermediate position in the wrapping unit during the winding of the web section round the roll of bags.
Figure 5:
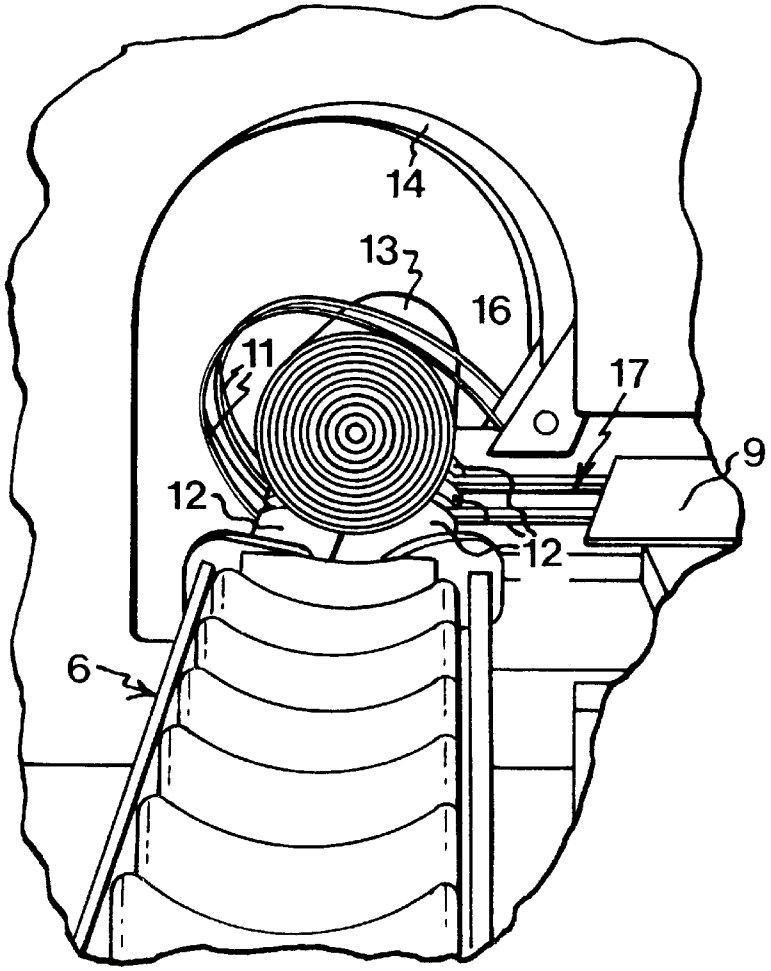
FIG. 5 is an enlarged side view showing a first intermediate position in the wrapping unit during the winding of a wrapping-forming web section round the roll of bags.

As appears from FIGS. 4–6, the illustrated embodiment of the wrapping unit 4 has two parallel, drivable and endless belts 11 forming two loops in the wrapping unit 4. The bolts 11 may be driven in any suitable fashion, for instance with the aid of a driven belt wheel brought into engagerment therewith.

Moreover, the wrapping unit 4 has two parallel, spaced-apart spindles, on which a number of support rollers 12 are fixedly mounted. These support rollers 12 are adapted to support a cylindrical roll of bags 13 fed into the wrapping unit 4. In the illustrated embodiment, each spindle is provided with three support rollers 12, which are spaced apart along the spindle. The support rollers 12 are so arranged on the spindles as to accommodate between them the two parallel belts 11, which above the spindles extend essentially perpendicularly to the longitudinal direction of the rollers 12.

An arcuate belt-guiding means 14, which is indicated by dashed lines in FIG. 4, is arranged in the wrapping unit 4. The one end potion of the guiding means 14 is rotatably mounted on a shaft 15, which is parallel to said spindles and is located outside the belt loops 11. A number of wedge-shaped guiding lugs 16 are provided on the other, free end portion of the guiding means 14. The respective belts 11 are accommodated in a carrier assembly (not shown) on the free end portion of the belt-guiding means 14. Each carrier assembly has at least one rotatable carrier and one end plate, between which extends the belt 11. The free, quiding-wedge-equipped end portion of the belt-guiding means 14 may, by pivoting the belt-guiding means 14 in the direction of the belt loops 11, be brought to thle vicinity of the support rollers 12, as illustrated in FIGS. 5 and 6.

In front of the support rollers 12, the pair of belts 11 forms a flat feeder web 17. Here, the belts 11 rest on a suction box generating a negative pressure between and round the pair of belts 11.

The wrapping unit 4 further comprises a tensioning means (not shown), which is adapted to control the tensioning of the belts 11. This tensioning means may, for instance, comprise belt rollers which are applied against the belts 11 and which can be moved in the direction of the belts, so as to increase the tensioning thereof. The tensioning means should be adapted to be applied against that part of the belts 11 which is located at a distance from the feeder web 17, the support rollers 12 and the belt-guiding means 14, thereby to avoid that the belts 11 are dislodged during the tensioning procedure.

The application of a wrapping round a roll of bags in the wrapping machine is so carried out that a web, which is to form the wrapping, is supplied and cut into web sections 9 of suitable length. The web section 9 is provided with a glue thread and is conveyed to the wrapping unit 4.

A roll of bags 13 is fed into the wrapping unit 4 via the supply unit 5 for rolls of bags, whereupon the roll of bags 13 is arranged within the bell loops 11 and on the support rollers 12 (FIG. 4). The belts 11 then rest in the spaces between the support rollers 12 and are located at a distance from the circumferential surface of the roll of bags 13, thereby to obviate the risk of the roll of bags 13 being deformed when fed into the wrapping unit 4. A deformation of the roll of bags 13 might result in the web section 9 being obliquely applied or being applied with insufficient tension round the roll of bags 13.

Thus, the feed-in direction of the roll of bags 13 is perpendicular to the winding plane, i.e. the geometric plane in which the web section 9 is wound round the roll of bags 13. In this embodiment, the winding plane is vertical and parallel to the belt loops 11 in the wrapping unit 4.

By means of the conveying arm 10, a glued web section 9 is placed on the feeder web 17 in front of the roll of bags 13. On the feeder web 17, the web section is sucked towards the belts 11 under the action of the negative pressure generated by the suction box.

When the web section 9 has been arranged on the feeder web 17, the belt-guiding means 14 is pivoted in the direction of the belts 11, such that the letter, which are applied against the above-mentioned carriers at the free end portion of the belt-guiding means 14, are guided along a path round a substantial part of the circumference of the roll of bags 13 (FIG. 5).

Then, the belts 11 are increasingly tensioned with the aid of the tensioning means, such that the belts 11 are tensioned round the roll of bags 13 while being brought into engagement with the driven belt wheel. As a result, the belt loop 11 is driven clockwise in the wrapping unit 4, the roll of bags 13 beginning to rotate , as is indicated by an arrow in FIG. 6. The movement of the belts 11 results in a simultaneous displacement of the web section 9 placed on the feeder web 17 in the direction of the rotating roll of bags 13.

The front end portion of the web section 9 is then brought into engagement with the circumferential surface of the rotating roll of bags 13, end is clamped between the belts 11 and said circumferential surface. Owing to simultaneous clamping and rotation, the web section 9 is then wound round the roll of bags 13.

In the position illustrated in FIG. 6, in which the web section 9 has been wound almost a whole turn round the roll of bags 13, the front end portion of the web section 9 is so guided by means of the guiding wedges 16 as to follow the circumferential surface of the roll of bags 13, the web section 9 being thus wound round the roll of bags 13 to form a close wrapping.

The belts 11 essentially enclosing the roll of bags 13 tension the web section 9 round the roll of bags 13 and also ensure that the glue thread is evenly applied against an opposing part of the wound-up web section 9. In this manner, it is ensured that the wrapping is fixed round the roll of bags 13 in a perfectly reliable fashion.

After the wrapping has been thus applied, the tensioning of the belts 11 is reduced, and the belts 11 and the roll of bags 13 thus cease to rotate. The belt-quiding means 14 is pivoted back to its initial position (shown in FIG. 4), its free end portion being displaced at a distance from the support rollers 12 and the roll of bags 13. Being accommodated in the free end portion of the belt-guiding means 14, also the belts 11 are moved away from the roll of bags 13 during this operation. Then, the wrapped roll of bags 13 is further conveyed by means of the discharging unit 6 for rolls of bags.

Figure 7:
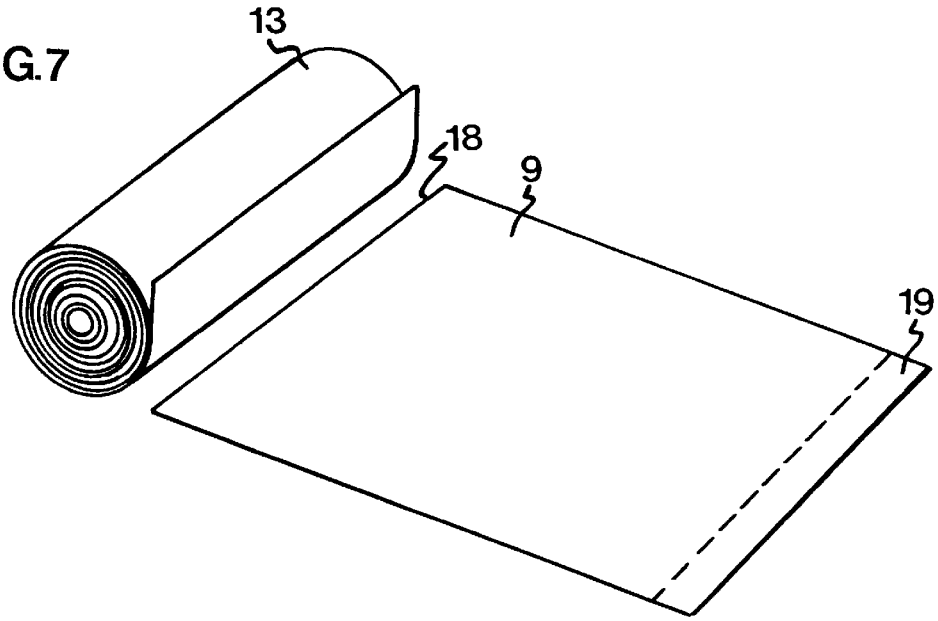
FIG. 7 is a schematic perspective view showing the initial position of the roll of bags and of the web section.
Figure 8:
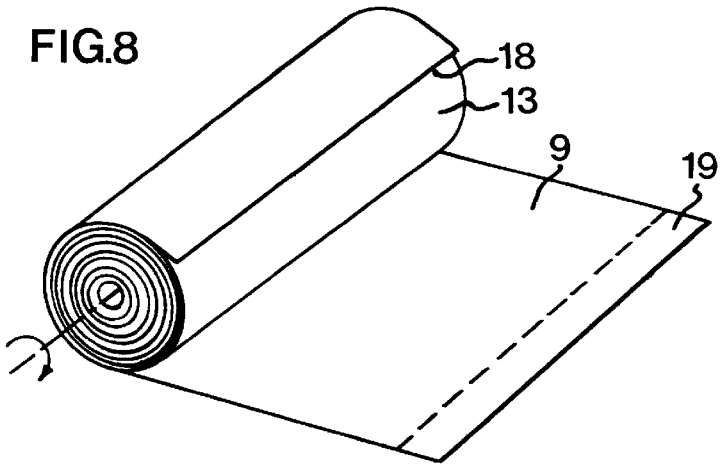
FIG. 8 is a similar perspective view showing an intermediate position during the winding of the web section round the roll of bags.
Figure 9:
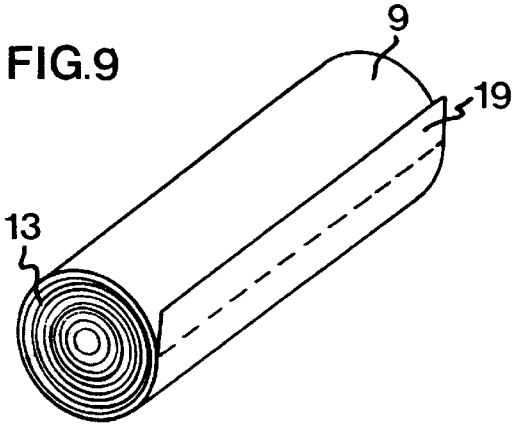
FIG. 9 is a similar perspective view showing a wrapped roll of bags.

FIGS. 7–9 schematically illustrate how a web section 9 is wound round a roll of bags 13. thus, FIG. 7 shows a roll of bags 13 and a web section 9 which are located at a distance from one another, The one edge portion 18 of the web section 9 is disposed in parallel with the longitudinal direction of the roll of bags 13. A glue thread 19 is applied on the end portion of the web section 9 that faces away from the roll of bags 13. The roll of bags 13 is so oriented that its winding is opposite to its subsequent direction of rotation.

FIG. 8 illustrates an intermediate position, in which the roll of bags 12 is rotated and the web section 9 is clamped against its circumferential surface. As a result, the web section 9 is wound round the roll of bags 13. The direction of rotation of the roll of bags is, in FIG. 8, indicated by an arrow round an axis of rotation (dashed lines).

In order that the web section 9 should follow the circumferential surface of the roll of bags 13, the front edge portion 18 of the web section 9 must be guided round the roll of bags 13, which in the above embodiment (FIGS. 4–6) is achieved with the aid of the belts 11 in combination with the guiding wedges 16.

It appears from FIG. 9, which illustrates a wrapped roll of bags, that the rear end portion of the web section 9 overlaps the front end portion. In order to produce such overlapping, the length of the web section 9 has to exceed the circumference of the roll of bags 13.

It should here be observed that the web intended to form the wrappings round the rolls of bags need not be made of paper. Depending on tile application at issue, other pliable materials, such as plastic, may also be used.

Furthermore, the web section may be connected to the web section wound round the roll of bags in optional fashion. Thus, the glue thread may, for instance,. be replaced with one or more strips of tape, which are applied over the joint between the free rear end portion of the web section and the wound-up web section.

Neither is the number of belts in the wrapping unit of decisive importance for the invention. Thus, the endless belts described above may be replaced with a single broad belt or a plurality of narrow belts.

I claim:

1. A device for applying a wrapping around a cylindrical roll of bags, comprising:

a first feeding unit for feeding a web that is to form the wrapping;

a cutting unit for cutting the web into web sections of suitable length;

a second feeding unit for feeding the roll of bags to a winding station; and a wrapping unit for winding a web section around the roll of bags at the winding station, said wrapping unit including means for feeding a front end portion of the web section, relative to a feeding direction of the web section, to a site adjacent to a circumferential surface of the roll of bags and for gripping the roll of bags and the adjacent front end portion of the web section and rotating the roll of bags about a longitudinal axis of the roll of bags so as to wind the web section around the roll of bags, the means for feeding and gripping having at least one endless belt for both feeding and gripping, the at least one endless belt being arranged to encircle roll of bags from a time when roll of bags enters the wrapping unit, a mechanism for driving the at least one endless belt, and an operating means for bringing the at least one endless belt into engagement with the circumferential surface of the roll of bags encircled by the belt, means for connecting a rear end portion of the web section to a portion of the web section wound around the roll of bags; and a unit for discharging wrapped rolls of bags.

2. A device as set forth claim 1, wherein the roll of bags is so oriented in the wrapping unit that the winding of the roll of bags is opposite to the direction of rotation of the roll of bags.

3. A device as set forth in claim 1, wherein the means for feeding and gripping further includes at least one guiding wedge, which is adapted to guide the front end portion of the web section around the roll of bags during the rotation of the roll of bags.

4. A device as set forth in claim 1, wherein the means for feeding and gripping further includes negative-pressure means for keeping the web section in place by suction when the web section is being propelled.

5. A device as set forth in claim 1, wherein the first feeding unit includes an arm which is movable in a direction perpendicular to the feed-in direction of the web and which is adapted to convey the web section from the cutting unit to the wrapping unit.

6. A method for applying a wrapping around a cylindrical roll of bags, comprising cutting a web to form the wrapping into web sections of suitable length;

introducing the web section into a wrapping unit;

employing at least one endless belt to feed a first end portion of the web section to a roll of bags in the wrapping unit;

employing the at least one endless belt to apply and clamp said first end portion of the web section on the outside of the roll of bags;

employing the at least one endless belt to rotate the roll of bags about a longitudinal axis of the roll of bags, such that the web section is wound around the roll of bags by the at least one endless belt; and connecting a second end portion of the web section to a portion of the web section wound around the roll of bags, thereby wrapping the roll of bags with the web section.

7. A method as set forth in claim 6, wherein the web section is cut to a length exceeding a circumference of the roll of bags, and the web section is wound around the roll of bags in such a manner that the second end portion of the web section overlaps the first end portion of the web section.

8. A method as set forth in claim 6, wherein the roll of bags is so oriented in the wrapping unit that the winding of the web section around the roll of bags is opposite to a direction of rotation of the roll of bags.

9. A method as set forth in claim 6, wherein the web section is conveyed to the winding station in a direction perpendicular to the feed-in direction of the web.

10. A device as set forth in claim 1, wherein the roll of bags is conveyed into the wrapping unit in a direction perpendicular to a direction in which the front end portion of the web section is fed into the wrapping unit.

11. A method as set forth in claim 6, wherein the roll of bags is conveyed into the wrapping unit in a direction perpendicular to a direction in which the front end portion of the web section is introduced into the wrapping unit of bags.

* * * * *